US005571045A

United States Patent [19]

Tsung

[11] Patent Number: 5,571,045

[45] Date of Patent: Nov. 5, 1996

[54] ASSEMBLABLE TURBINE AIR PUMP

[76] Inventor: Kuo-Shung Tsung, 1F, No. 17, Lane 51, Heng-Kuang Road, Taipei, Taiwan

[21] Appl. No.: 499,925

[22] Filed: Jul. 10, 1995

[51] Int. Cl.[6] ..... F23L 17/10

[52] U.S. Cl. ..... 454/18; 454/366

[58] Field of Search ..... 454/18, 19, 366, 454/367, 368

[56] References Cited

U.S. PATENT DOCUMENTS 3,267,833 8/1966 Artis et al. ..... 454/18

3,392,659 7/1968 Rousey ..... 454/18

3,797,374 3/1974 Jones ..... 454/18

FOREIGN PATENT DOCUMENTS 45-15549 5/1970 Japan ..... 454/18

*Primary Examiner*—Harold Joyce

*Attorney, Agent, or Firm*—Bacon & Thomas

[57] ABSTRACT

A user assemblable turbine air pump includes mainly a top lid, an axle assembly, a bottom seat plate, a blade supporting ring, three blade supports, four bottom seat supporting legs and a plurality of blades, these are classified and lapped in a styrofoam made box.

3 Claims, 4 Drawing Sheets

ASSEMBLABLE TURBINE AIR PUMP

BACKGROUND OF THE INVENTION

1. Field of the Invention

The present invention relates to an assemblable turbine air pump, it includes a main apparatus and a fixing seat structure, the members of the main apparatus can be divided into several groups and put in a styrofoam made box to save space for storing and shipping, they can be easily mounted with the light, good looking but firm fixing seat structure on a roof for operating by natural wind force.

2. Description of the Prior Art

1) Background:

A turbine air pump Uses natural wind force to move air flow in any horizontal direction or change the same into a vertical movement, it can effectively eliminate the hot air, the humid air, the exhausted air and the bad odor in door; not only noise is extinguished, but also exhausting of energy is stopped thereby, it has been widely used on various types of buildings. According to the records, mankind has taken advantage of this to design various products for several hundred years.

2) Defects of conventional products:

A turbine air Pump inherently has the defects of huge volume and weak structure, it is like an umbrella capable of being opened but unable of being folded down, it makes waste of cost in packaging, shipping as well as storing when in the procedures of production and selling, its rate of damage is very high, therefore it is difficult in selling promotion. In view of this, it is substitued gradually by electric Fans popularizing day by day. This makes big loss to those people who live in the hard districts and suffer from expensive energy sourse and are lack of electricity.

3) Contemplation of the invention:

The present invention improves against the defects of the conventional turbine air pump in respect of assembling of products, structural design as well as packaging of products with contemplation of capability of "opening the umbrella and also folding down thereof", this is for large reducing of cost, and can render the operation of assembling as well as mounting to be convenient. So that the products can be more cheaper and benefitial to selling promotion thereof.

4) Improvement scheme:

Conventional products are all assembled ones, each has a huge volume and a weak structure, they are unconvenient for storing and shipping and are subjected to being damaged. The improvement of the present invention resides in keeping the products in the form of "half-finished products", a user can assemble a product like such easily in a short time. Wherein, only the assembling works of the bearing, the bearing block and the main axle are more difficult and need special tools and professional technique, thereby, before shipping out from the factory, they are assembled into "an assembly of main axle"; this can reduce trouble in self assembling, and can maintain accuracy of the bearing, assure stable operation of the main apparatus for a long term, besides, other assembling work is very simple; such self assembling mode is exatly the world wide popularized DIY, i.e.: Do it by yourself. The saved workman payment for assembling can be fed back to the customers by lowering selling prices.

Moreover, conventional products being huge in volume are not good for shipping as well storing, improvement of the present invention allows the parts to be lapped with one another by classes and then are embedded in the respective grooves in a receiving body made of styrofoam, thereafter are putting into a carton box. In this way, not only the volume thereof can be largely reduced, but also the costs of packaging, shipping and storing can be largely lowered; press as well as impact resistance of the products can also be effectively enhanced, yet rate of damage during shipment can be lowered to approach zero. The grooves in the receiving body made of styrofoam can provide the best protection and the most suitable measuring instruments for the deformable parts ready for calibration which might be necessary during assembling and maintaining. The present invention is convenient for assembling, thereby when the main apparatus is out or work, the user can dismantle it by himself to remove failure.

Besides, as compared to the conventional main apparatus of which the blade supporting ring and the bottom seat therein normally are made into "one piece" or "integrately formed" type, the present invention effectively reduces the packaging volume by improvement thereof, it can also benefit assembling thereof, the blade supporting ring is changed to a type having "three pieces", when it is to assemble a blade support, the blade supporting ring is combined and formed into a round shape; and by virtue of the fixing seat provided in the present invention, after assembling, the part for connecting the main apparatus is in a shape of a firm cylinder, hereby the annular bottom seat in the conventional apparatus is amended for avoiding wasting due to structural repetition and to include a bottom seat plate and a plurality of supporting legs. While connecting mode therein is changed from "rivetting" or "welding"in the conventional apparatus to fixing by screwing, all the corresponding holes for screwing are tapped in antecedence; to avoid loosening of the screws by virtue of long term operation of the main apparatus, instant adhesive can be applied between the screws and the screw holes after assembling in favor of fixing.

Conventional fixing seats are divided into two pes: fixed type and variable angle type, these types have the common defect of huge volume, unmovability and heaviness; weight of the variable angle type can be lighter, however, it has a poor firmness, inferior wind resistance, and is subjected to being damaged in storing, shipping or mounting, and even the life of use is comparatively short afater it is assembled. Improvement of the present invention resides in an amended structural design and material for the fixing seats: it is made of angle iron and is covered with fiber glass (FRP). So that strength of the fixing seats will not be diminished, but weight thereof will be largely reduced, and the cost of production can be relatively low. As for the design thereof, they are divided each into an upper fixing seat and a lower fixing seat, the two portions are further divided into 4 equal parts respectively, so as to save space of storing as well as shipping, they can be reassembled by fixing on the angle irons with screws; the bottom of the upper fixing seat (i.e., the surface connected with the surface of a building) can be cut or sawn to fit inclination of the roof, and further is connected with the vertical surfaces of the lower fixing seat with screws, and finally, the bottom surface of the lower fixing seat is fixed onto the beams around the vent provided on the roof, the main apparatus thus is most stably fixed in horizontal and vertical directions. Such improvement not only effectively reduce weight and packaging volume of the fixing seat, but also effects a beautiful style, firmness and durability, easy mounting, and large lowering of cost of material. The upper fixing seat and the lower fixing seat of the present invention is made of tough material they don't need to be put in a styrofoam made box for protection, an ordinary carton box is alright.

SUMMARY OF THE INVENTION

Objects of the present invention:

(1) the main object of the present invention: is to provide an assemblable turbine air pump which is convenient for assembling, the improvement thereof is to amend the original huge as well as weak apparatus to be a largely volume reduced and press as well as impact resistant one by a special structural design; not only cost of storing as well as shipping is lowered, but also fluidity of the products can be raised, people in remote areas suffering from inconvenient traffic can be benefitted thereby.

(2) the secondary object of the present invention: is to provide an assemblable turbine air pump which is a product still taking advantage of natural wind and needing no energy source, but can be operated in a more convenient, cheaper as well as more effective mode and can be widely accepted by people.

(3) the third object of the present invention: is to provide an assemblable turbine air pump which can be assembled, maintained by the user himself, the payment for workmen saved can be fed back to the customers by lowering selling prices.

The present invention will be apparent in its practical structure and mode of assembling after reading the detailed description of the preferred embodiment thereof in reference to the accompanying drawings.

BRIEF DESCRIPTION OF THE DRAWINGS

FIG. 4—A is a sectional view taken from the sectional line A—A in FIG. 4;

DETAILED DESCRIPTION OF THE PREFERRED EMBODIMENT

Figure 1:
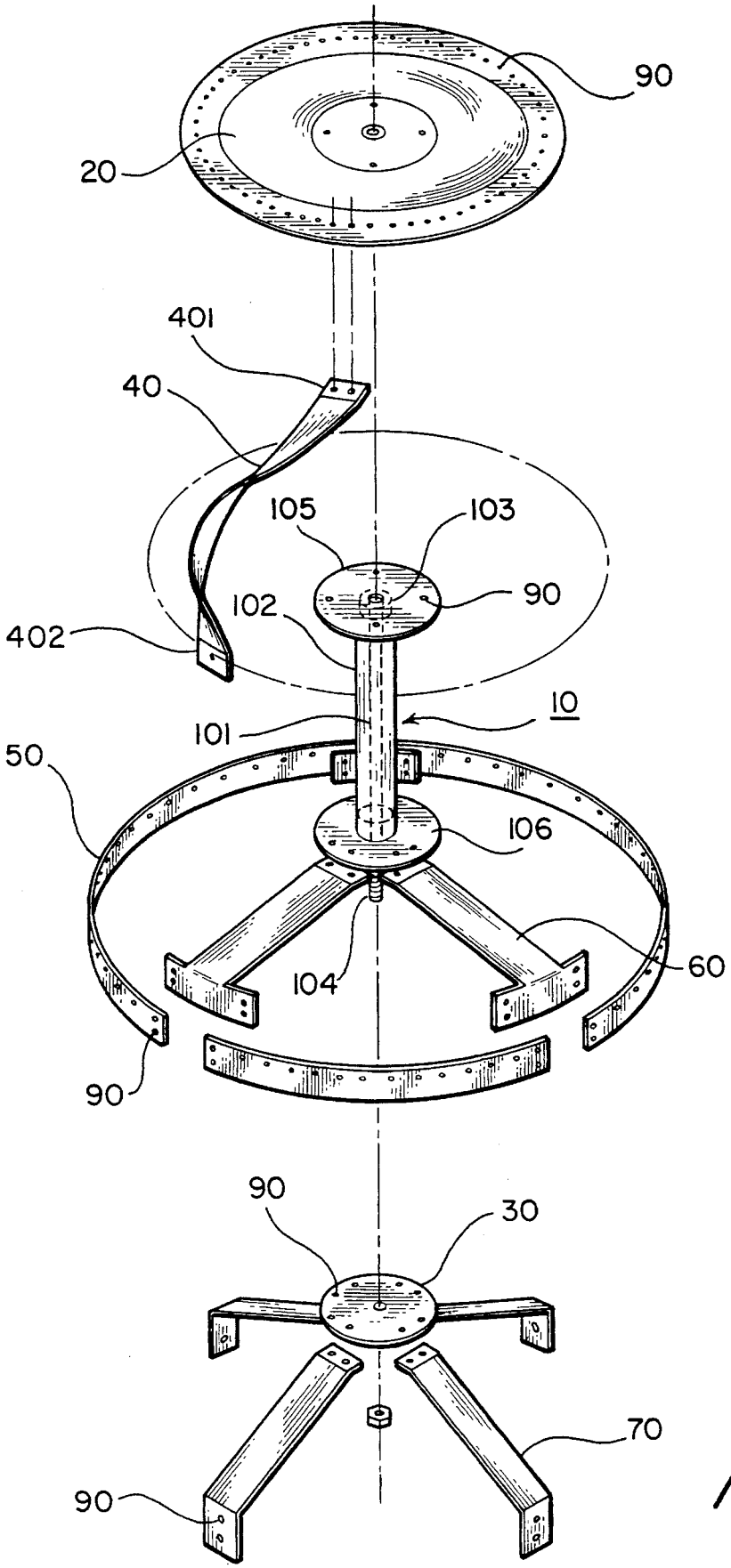
FIG. 1 is an analytic perspective view of the present invention.

It can be seen from FIG. 1 that the main apparatus of the present invention has the similar function done by a stator and a rotator in a fan, and can be specified in two parts which are stationary and motional; wherein the stationary part includes:

a pipe shaped main axle assembly 10, which is composed of an a bearing block 102 slipped over a main axle 101 and an upper and a lower bearings 103 inserted between the main axle 101 and the bearing block 102, the bottom end of the main axle 101 extends downwards to a distance to form a bolt 104 benefitial to connection of a bottom seat plate 30; the upper and lower ends of the bearing block 102 is provided with an upper and a lower fixing plates 105, 106, a plurality of screw holes 90 are provided on the surfaces of the plates.

the round shaped bottom seat plate 30, which has a plurality of screw holes 90 on the surface thereof, and is capable of being connected with a plurality of L shaped bottom seat supporting legs 70 which are extended downwardly and outwardly from the center of the bottom seat plate 30, thus to form a cross like bottom seat support, the bolt 104 having thread on the bottom end of the main axle 101 is inserted in the central hole of the bottom seat plate 30 and is fixed by a nut; assembling of the stationary part thus is completed.

While the motional part includes:

a round shape top lid 20, which has four screw holes 90 in the center area thereof, and a plurality of screw holes 90 are provided along its periphery;

a plurality of arc shaped blades 40 which are slightly twisted, and are designed for preventing the main apparatus from getting rain leak and for increment of wind resistance of the same, the upper end 401 of the blade 40 has two screw holes, while the lower end 402 thereof has a single screw hole;

three arc shaped blade supporting parts forming a supporting ring 50, they all have a plurality of screw holes 90 on the surface thereof, and have a pair of screw holes at both ends thereof;

three T shaped blade supports 60 each with two pair of screw holes provided at the outter end thereof, and with a pair of screw holes 90 provided at the inner end of thereof.

When in assembling, the three parts of the supporting ring 50 are connected end with end and are connected to the three blade supports 60, thereby, the supporting ring 50 is combinated into a round shape, while the blade supports 60 are extended downwardly and outwardly from the center of the lower fixing plate 106. Then the upper end 401 and the lower end 402 of each blade 40 are respectively fixed to the corresponding screw holes 90 on the top lid 20 and the supporting ring 50, in this way, assembling of the sphere like motional part is completed.

Finally, the stationary part and the motional part are connected together, wherein the screw holes 90 in the central portion of the fixing plates 105 and the top lid 20 are connected together, and the same is done for those screw holes 90 on the lower fixing plates 106 and the inner ends of T shaped parts of the blade support 60; assembling of the main apparatus thus is completed.

Figure 2:
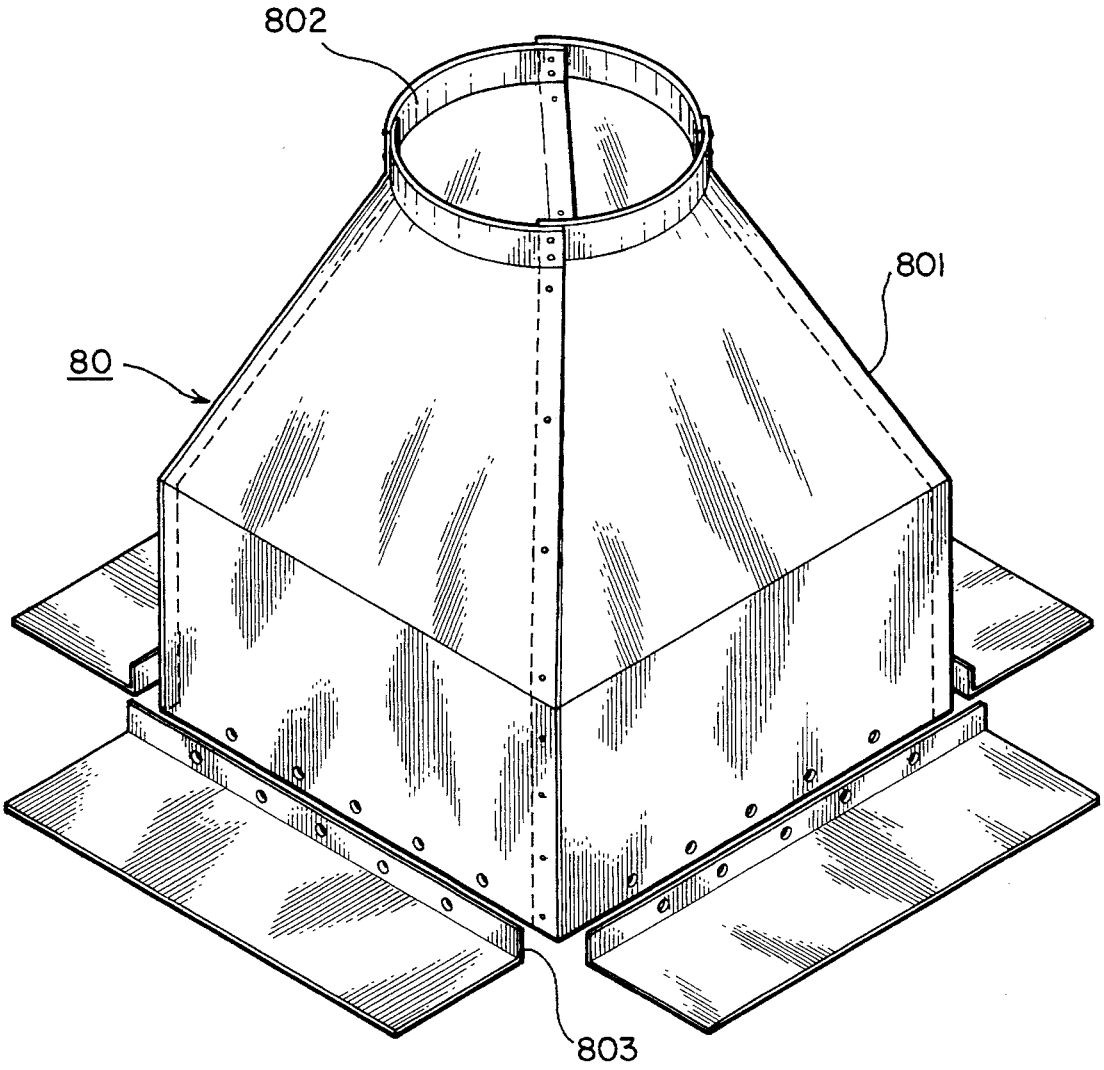
FIG. 2 is an analytic perspective view of the fixing seat of the present invention.

As shown in FIG. 2, the present invention has a fixing seat 80 of which the frame is made of angle irons, then is covered with glass fiber (FRP), and is divided into an upper and a lower parts 801,803, wherein:

the upper fixing seat 801 is composed of four similar sheets, and is a hollow body with its upper end in a round shape while its bottom end in a square shape, looks like a truncated conical stand used in traffic control, and has a connecting ring 802 on the top thereof;

the lower fixing seat 803 is composed of other four similar L shaped sheets.

When in assembling, the four similar sheets of the upper fixing seat 801 are fixedly connected one with the others with screws except every pair of holes on the connecting ring 802 on the top thereof.

Figure 3:
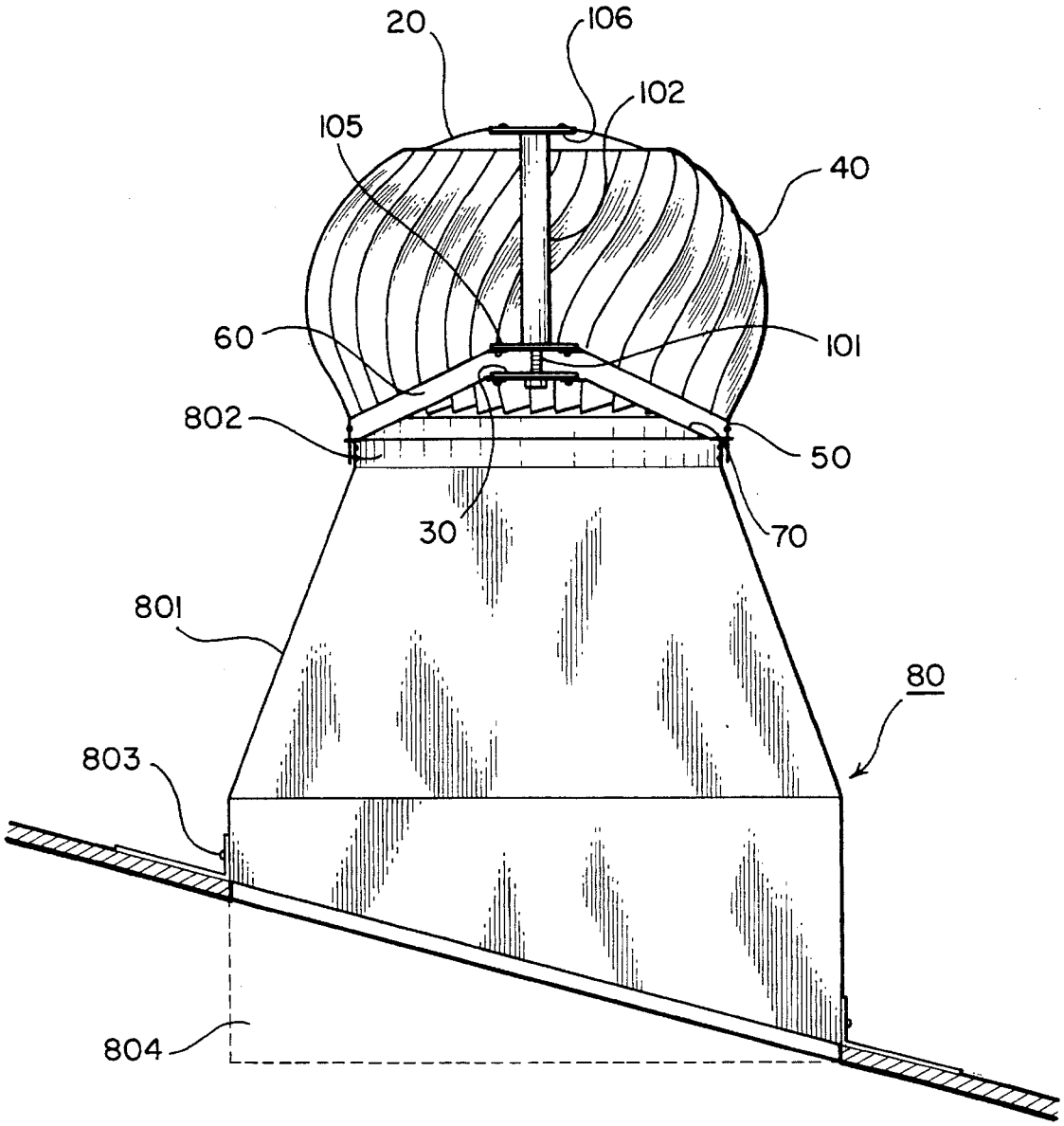
FIG. 3 is a partial sectional view of the present invention afater assembling.

The bottom of the upper fixing seat 801 is connected to the lower fixing seat 803 with screws and is fixed on the beams around the vent provided on a roof. A portion of the upper fixing seat 801 i.e., the unnecessary portion 804, can be cut away for fitting with the inclination of the roof such as shown in FIG. 3, when the present invention is mounted on the roof, the main apparatus thereof can be operated keeping in a stable state both in horizontal as well as in vertical directions. Connection between the upper fixing seat 801 and the lower fixing seat 803 and between the lower fixing seat 803 and the roof are all done by the user by drilling and fixing with screws. And lastly, the corresponding screw holes 90 on the connecting ring 802 on the top of the upper fixing seat 801 and the bottom seat supporting legs 70 of the main apparatus are screwed together, thus assembling of the present invention is completed.

Connection of the fixing seat 80 and the roof renders the bottom seat supporting legs 70 together with the bottom seat plate 30 and the main axle 101 to keep constant stable state. And when the bearing block 102 is pushed by an external force, it can be rotated freely on the bearings 103, thereby, the top lid 20 of the upper and lower fixing plates 105, 106 on the bearing block 102 and the three blade supports 60 as well as the supporting ring 50 fixed on the three blade supports 60 and the plural arc shaped blades 40 fixed between the top lid 20 and the supporting ring 50, in other words, the whole motional part, is rotated therewith. When there is natural wind blowing from any direction, wind resistance of the arc shaped blades 40 and wind discharging action by twisting of the blades 40 and yet the sequential arrangement of the blades 40 render the bearing block 102 and its corresponding motional part to be continuously pushed and rotated clock wise, and continuously send the air coming in from the side facing the wind out of the reverse side, and meantime guide the air to flow upwardly from the lower area to effect the air pumping function of the turbine. When temperature indoor is elevated, rising hot air can promote rotation of the turbine and thus enlarges the function of gas discharging and temperature lowering there Of.

Figure 4:
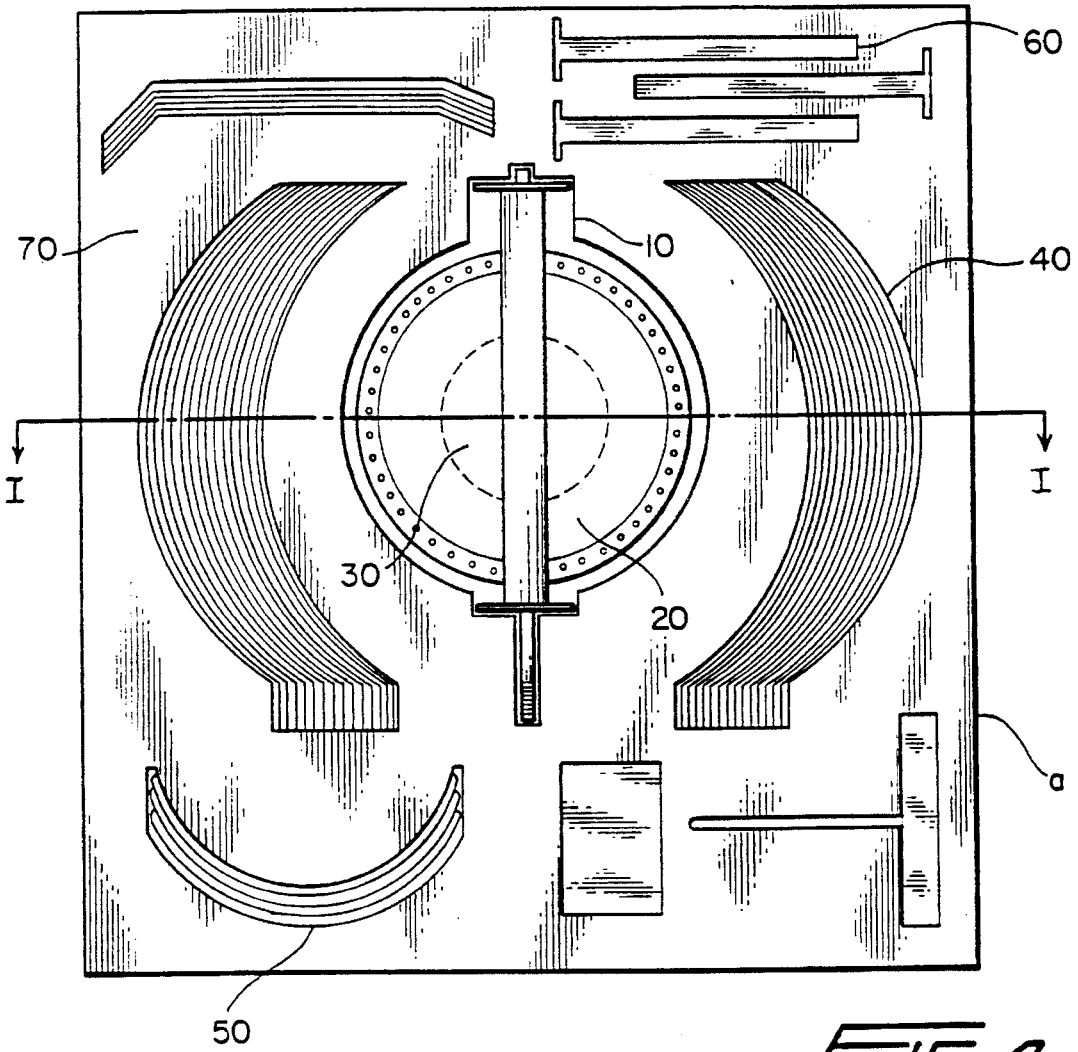
FIG. 4 is a schematic view of the elements of the present invention in packaging.
Figure 4A:
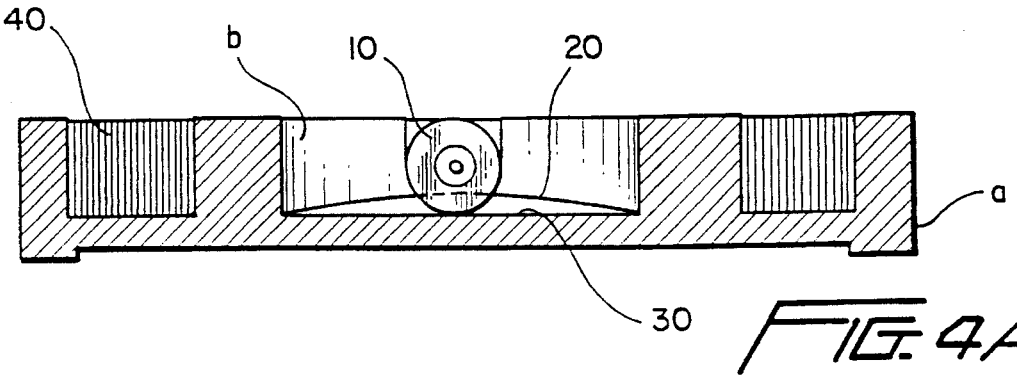

One thing worth of mentioning, all the members in the present invention, except the rod like main axle assembly 10, including the top lid 20, the bottom seat plate 30, the supporting ring 50 and the three blade supports 60, the bottom seat supporting legs 70 and the plural arc shaped blades 40, are in sheet shape; when they are thoughtfully arranged, they can be put into a packaging box, and can be assembled when in mounting, this can largely save the packaging space. The packaging method of the present invention (as shown in FIG. 4) is as follows, several grooves b of suitable sizes are provided in the styrofoam box a, the members of similar shapes including the top lid 20 and the bottom seat plate 30 are lapped one with another in the centtral groove firstly, then the main axle assembly 10 is put over them and is embeded, the plural arc shaped blades 40 of a similar shape are disposed bilaterally at both sides of them, the bottom seat supporting legs 70 and the three blade supports 60 are disposed respectively at the left and right upper corners of the box, the three arc shaped blade supporting parts forming the the supporting ring 50 are lapped at the left lower corner and lastly, a multifunctional T shaped tool (the combination of a double ended socket spanner and a cross-screw driver) and fittings thereof (screws etc.) are disposed at the right lower corner, after disposing, they are packaged in a carton box, work of packging is hereby completed. In such a well protected method, all the members are not subjected to collision due to displacement, nor subjected to pressing or impacting of external force which can make damage; moreover, space occupied by them are largely reduced to about 20% of the original measures. The fixing seat 80 after improvement of the present invention not only is lighter but also is firmer due to the material it is made of, it is not necessary to be disposed in a styrofoam box, lapping of the sheets of the upper fixing seat 801 and the lower fixing seat 803 also largely reduce the space they occupy, a carton box is enough for them.

Accordingly, by the structural characteristics of assembling the turbine air pump of the present invention, space for packaging, storing and shipping the products can be reduced, while the products can be perfectly protected, this not only lowers cost but also fluidity of the products which still taking advantage of natural wind and needing no energy source, but can improve efficiency as comparing to the conventional turbine air pump, and can be more widely accepted by people.

Having thus described my invention, what I claim as new and desire to be secured by Letters Patent of the United States is:

1. An assemblable turbine air pump, including:

a pipe shaped main axle assembly which is composed of a bearing block slipped over a main axle, an upper and a lower bearings inserted between said main axle and said bearing block, the bottom end of said main axle extending downwards to a distance to form a bolt, the upper and lower ends of said bearing block being provided with an upper and a lower fixing plates having a larger diameter than that of said bearing block, a plurality of screw holes being provided on the surfaces of said plates;

a round disk like top lid which has four screw holes in the center area thereof for fixing on the top of said upper fixing plate, and has a plurality of screw holes provided along its periphery;

a plurality of T shaped blade supports capable of being fixed on the bottom of said lower fixing plate, being extended downwardly and outwardly from the center of the same when is assembled, and having two pair of screw holes provided at the outter end thereof and a pair of screw holes provided at the inner end of thereof;

a plurality of arc shaped blade supporting parts which can be connected end with end to form a blade supporting ring in a round shape, said supporting ring having a plurality of screw holes on the surface and around the periphery thereof;

a plurality of arc shaped blades which can be fixed at the top end thereof to said top lid and at the bottom end thereof to the periphery of said blade supporting ring, said blades being arrayed to form a sphere like body;

a round shaped bottom seat plate which has a plurality of screw holes on the surface thereof and a central hole connectable with said bolt on the bottom end of said main axle;

a plurality of L shaped bottom seat supporting legs capable of being fixed on the bottom of said bottom seat plate, and being extended downwardly and outwardly from the center of the same, and having a pair of screw holes on their respective ends;

a fixing seat which has a connecting ring on the top thereof and can be fixed to said bottom seat supporting legs, the bottom of said fixing seat being fixed on a vent provided on a roof to secure said bottom seat plate and said main axle;

said bearing block, and said top lid, said blade supporting ring, as well as said blades directly or indirectly fixed on said bearing block can rotate in pursuance of wind force, in this way, function of said turbine air pump can be effected.

2. An assemblable turbine air pump as state in claim 1, wherein, said fixing seat is divided into an upper and a lower fixing seats, said upper fixing seat is composed of four similar sheets and is a hollow body with the upper end in a round shape while the bottom end in a square shape, the upper end being a connecting ring having screw holes for connecting with the screw holes on the external ends of said bottom seat supporting legs; the bottom of said upper fixing seat can be partially cut away for fitting with the inclination of the roof, and is fixedly connected to said lower fixing seat composed of four similar L shaped sheets, the L shaped sheets is fixed on beams around a vent provided on the roof.

3. An assemblable turbine air pump as state in claim 1, wherein, said top lid, bottom seat plate, blades, blade supporting ring, and bottom seat supporting legs of similar shapes are lapped respectively in groups, and are packaged, with said main axle assembly, in a styrofoam made box, and can be assembled when in mounting, in this way, space for storing and shipping can be largely saved, while convenient mounting can be achieved.

* * * * *